US006948466B2

(12) United States Patent
Haas et al.

(10) Patent No.: US 6,948,466 B2
(45) Date of Patent: Sep. 27, 2005

(54) FINGER LEVER OF A VALVE TRAIN OF AN INTERNAL COMBUSTION ENGINE

(75) Inventors: Michael Haas, Weisendorf (DE); Martin Rauch, Bamberg (DE); Bodo Rörig, Weisendorf (DE); Dieter Schmidt, Nümberg (DE); Jens Artmann, Regendorf (DE)

(73) Assignee: INA-Schaeffler KG, (DE)

( * ) Notice: Subject to any disclaimer, the term of this patent is extended or adjusted under 35 U.S.C. 154(b) by 33 days.

(21) Appl. No.: 11/043,254

(22) Filed: Jan. 26, 2005

(65) Prior Publication Data

US 2005/0132990 A1 Jun. 23, 2005

Related U.S. Application Data

(62) Division of application No. 10/841,138, filed as application No. PCT/EP02/11943 on Oct. 25, 2002.

(30) Foreign Application Priority Data

Nov. 14, 2001 (DE) ..... 101 55 800

(51) Int. Cl.[7] ..... F01L 1/18; F01L 13/00

(52) U.S. Cl. ..... 123/90.16; 123/90.41; 123/90.42; 123/90.44; 123/198 F

(58) Field of Search ..... 123/90.15, 90.16, 123/90.17, 90.39, 90.41–90.44, 198 F; 74/519, 74/559

(56) References Cited

U.S. PATENT DOCUMENTS 5,239,952 A 8/1993 Morita (Continued)

FOREIGN PATENT DOCUMENTS

| | | |
|---|---|---|
| DE | 43 26 332 | 2/1995 |
| DE | 195 15 367 | 11/1996 |
| DE | 196 52 765 | 6/1997 |
| DE | 196 37 066 | 3/1998 |
| EP | 0 267 696 | 5/1988 |
| EP | 0 735 249 | 10/1996 |

OTHER PUBLICATIONS

05141215, Jun. 8, 1993, Toru et al , Japanese Abstract.

*Primary Examiner*—Weilun Lo
(74) *Attorney, Agent, or Firm*—Muserlian, Lucas and Mercanti

(57) ABSTRACT

The invention proposes a finger lever (1) of a valve train of an internal combustion engine, said finger lever (1) being switchable to different valve lifts for at least one gas exchange valve and comprising an outer lever (2) having two arms (3*a*, 3*b*) between which an inner lever (4) is arranged for pivoting relative to the outer lever (2), which outer and inner levers (2, 4) can be coupled to each other by a coupling means (15), the outer lever (2) comprising on one closed end (5), a support (5*a*) for a gas exchange valve and the finger lever (1) comprising on an opposite end (6), a complementary surface (7, 30) for a support element, the inner lever (4) having a fulcrum (10) in a region of the opposite end (6), and at least this inner lever (4) comprising a contact surface (11) for a cam. In the finger lever (1) of the invention, the outer lever (2) has a substantially open fork-like configuration, the contact surface (11) for the cam on the inner lever (4) is configured as a rotatable roller (12) and the coupling means (15) comprises at least one slide (16, 19, 22) that extends crosswise to a longitudinal direction of the finger lever (1), an axial line of the at least one slide (16, 19, 22) coincides with an axial line of the roller (12), and the fulcrum (10) of the inner lever (4) is situated at least approximately at a same point on a length of the finger lever (1) as a fulcrum of the outer lever (2) in a region of the complementary surface (7) of the finger lever (1). The switchable finger lever (1) of the invention has only a small design space requirement and a coupling mechanism of a relatively simple structure.

11 Claims, 5 Drawing Sheets

U.S. PATENT DOCUMENTS

| | | | | |
|---|---|---|---|---|
| 5,529,033 | A * | 6/1996 | Hampton | 123/90.16 |
| 5,544,626 | A * | 8/1996 | Diggs et al. | 123/90.16 |
| 5,619,958 | A | 4/1997 | Hampton et al. | |
| 5,960,756 | A * | 10/1999 | Miyachi et al. | 123/90.16 |
| 6,318,317 | B1 * | 11/2001 | Hubschle | 123/90.16 |
| 6,321,705 | B1 * | 11/2001 | Fernandez et al. | 123/90.16 |
| 6,325,030 | B1 * | 12/2001 | Spath et al. | 123/90.16 |
| 6,439,179 | B2 * | 8/2002 | Hendriksma et al. | 123/90.16 |
| 6,467,445 | B1 * | 10/2002 | Harris | 123/90.16 |
| 6,588,387 | B2 * | 7/2003 | Cecur | 123/90.46 |
| 2001/0023675 | A1 | 9/2001 | Lee et al. | |
| 2001/0027764 | A1 | 10/2001 | Tanaka et al. | |
| 2001/0027765 | A1 * | 10/2001 | Hendriksma et al. | 123/90.44 |

* cited by examiner

FINGER LEVER OF A VALVE TRAIN OF AN INTERNAL COMBUSTION ENGINE

PRIOR APPLICATIONS

This application is a division of U.S. patent application Ser. No. 10/841,138 filed May 7, 2004, which is a 371 of PCT/EP02/11943 filed Oct. 25, 2002.

FIELD OF THE INVENTION

The invention concerns a finger lever of a valve train of an internal combustion engine, said finger lever being switchable to different valve lifts for at least one gas exchange valve and comprising an outer lever having two arms between which an inner lever is arranged for pivoting relative to the outer lever, which outer and inner levers can be coupled to each other by a coupling means, the outer lever comprising on one closed end, a support for a gas exchange valve and the finger lever comprising on an opposite end, a complementary surface for a support element, the inner lever having a fulcrum in a region of the opposite end, and at least this inner lever comprising a contact surface of a cam.

BACKGROUND OF THE INVENTION

A finger lever of the pre-cited type is disclosed in DE-OS 27 53 197. This finger lever likewise comprises an outer lever that encloses an inner lever that is pivotable relative thereto. The coupling means is configured as a latch. A drawback of this generic-type of finger lever is that it has a relatively large overall height. Besides this, it is to be remarked that the latch mechanism has a complicated structure and requires a comparatively sophisticated external loading. This means that in the installation of this finger lever, design space problems and the like can occur.

Further, SAE TECHNICAL PAPER 2000-01-0670 "Development of the High Power, Low-Emission. Engine for the Honda S2000" discloses on page 5, a switchable lever train that is made as an oscillating lever train and comprises for the identically operating gas exchange valves of each cylinder, a total of three axially adjacent lever arms that are coupled to one another by axially parallel displaceable slides. It is quite obvious that design space problems can occur precisely in camshaft direction especially with a compact arrangement of the cylinders. Moreover, this system of levers is made up of a relatively large number of individual parts and is therefore expensive.

OBJECT OF THE INVENTION

The object of the invention is to provide a finger lever of the pre-cited type in which the aforesaid drawbacks are eliminated and that particularly has a very compact structure and is simple to load.

SUMMARY OF THE INVENTION

The invention achieves the above object by the fact that the outer lever has a substantially open fork-like configuration, the contact surface for the cam on the inner lever is configured as a rotatable roller and the coupling means comprises at least one slide that extends crosswise to a longitudinal direction of the finger lever, an axial line of the at least one slide coincides with an axial line of the roller, and the fulcrum of the inner lever is situated at least approximately at a same point on a length of the finger lever as a fulcrum of the outer lever in a region of the complementary surface of the finger lever.

Due to this configuration, the aforesaid drawbacks are effectively eliminated. The finger lever of the invention has a vary compact overall structure that is also excellently suitable for retroactive implementation in existing engine designs. As proposed, the contact surface for the cam is constituted by a rotatable roller. This roller is preferably mounted on a roller bearing. However, if desired or necessary a sliding contact can also be used. The slides can advantageously be in the form of pistons or pins. The arrangement of the slides on the axis of the roller is a further contribution to achieving a compact structure. Besides this, separate measures for arranging the slides can be dispensed with. If desired or necessary, the slides may also be arranged outside of the axis of the roller. However, if these are offset toward the fulcrums, higher loads must be expected. The invention proposes a pack of three slides arranged in a row axially next to one another.

Preferably, displacement is effected in one direction (coupling or uncoupling direction) through the force of a mechanical means such as a compression spring. A displacement of the pack of slides in the opposite direction can be effected through the force of an external loading means such as an actuator of an electromagnet. However, it is also conceivable to use a variety of servo means for the displacement of the pack of slides, for example, hydraulic, magnetic or pneumatic means and the like. It is also possible to omit the compression spring and displace the pack of slides in both directions through the force of one or more of the aforesaid servo means.

The bushes in the outer lever for the second and the third slide are excellently adapted to be fine machined externally and then be fixed in the outer lever by the proposed fixing measures like press-fitting, swaging or gluing. If necessary or desired, it is also possible to omit the bushings so that the slides extend directly in receptions of the outer lever. The same applies also to the inner lever.

Particularly, if it is intended to use an external loading means for displacing the pack of slides in one direction, the invention proposes that one of the outer slides should project axially out of the arm concerned and should comprise a contact surface for the actuator of the electromagnet. If required, appropriate wear protection measures can be implemented on the projecting portion.

A further contribution toward obtaining light weight and a compact structure is that the inner lever likewise has an open, fork-like configuration similar to that of the outer lever. Both levers can be made of a light-weight material like sheet metal or a composite material.

If the finger lever is to be mounted on a hydraulic support element, this can get unnecessarily "pumped up" i.e., extracted in axial direction under the influence of the hydraulic medium pressure prevailing during the lost motion operation (uncoupled mode) of the finger lever. To prevent this, appropriate stops are arranged on the outer lever. These stops are configured as two raised counter contact surfaces that cooperate with base circle cams, not further specified here, of the camshaft. If desired, it is also possible to use other stops, for example such projecting from the cylinder head.

The complementary surface for mounting the finger lever on the support element can be configured as a cup-shaped recess or a cylindrical surface. It is proposed to arrange the cup-shaped recess on the outer lever and simply support the inner lever for pivoting on an upper side of the recess. However, it is also possible to mount the inner lever on the support element and support the outer lever with an appropriate counter surface on the upper side of the cup-shaped recess of the inner lever.

Finally, the invention also proposes simple measures for fixing the outer lever to the inner lever. For example, in the region of the cup-shaped recess, the inner lever can comprise two sideward projected axle stubs on which the outer lever is supported through appropriate mounting eyes. It is further conceivable, for example, to arrange a continuous axle to extend through the outer lever and mount the inner lever for pivoting thereon. It is further possible to arrange an appropriate axle in the inner lever and to mount the outer lever through mounting eyes or bores on projecting ends of this axle.

The invention will now be described more closely with reference to the appended drawing.

DETAILED DESCRIPTION OF THE DRAWING

Figure 1:
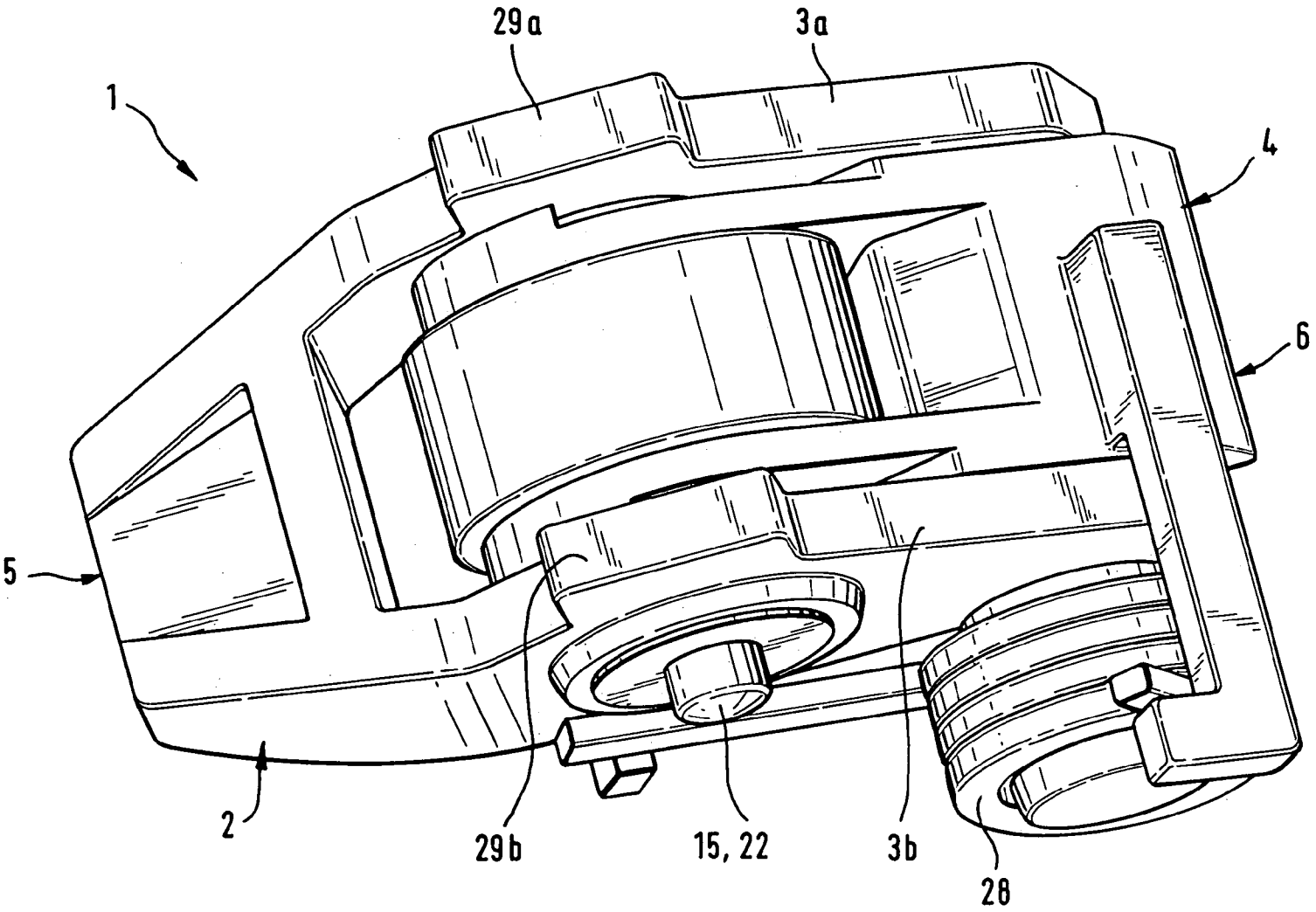
FIG. 1 is a three-dimensional representation of a finger lever of the invention.
Figure 3:
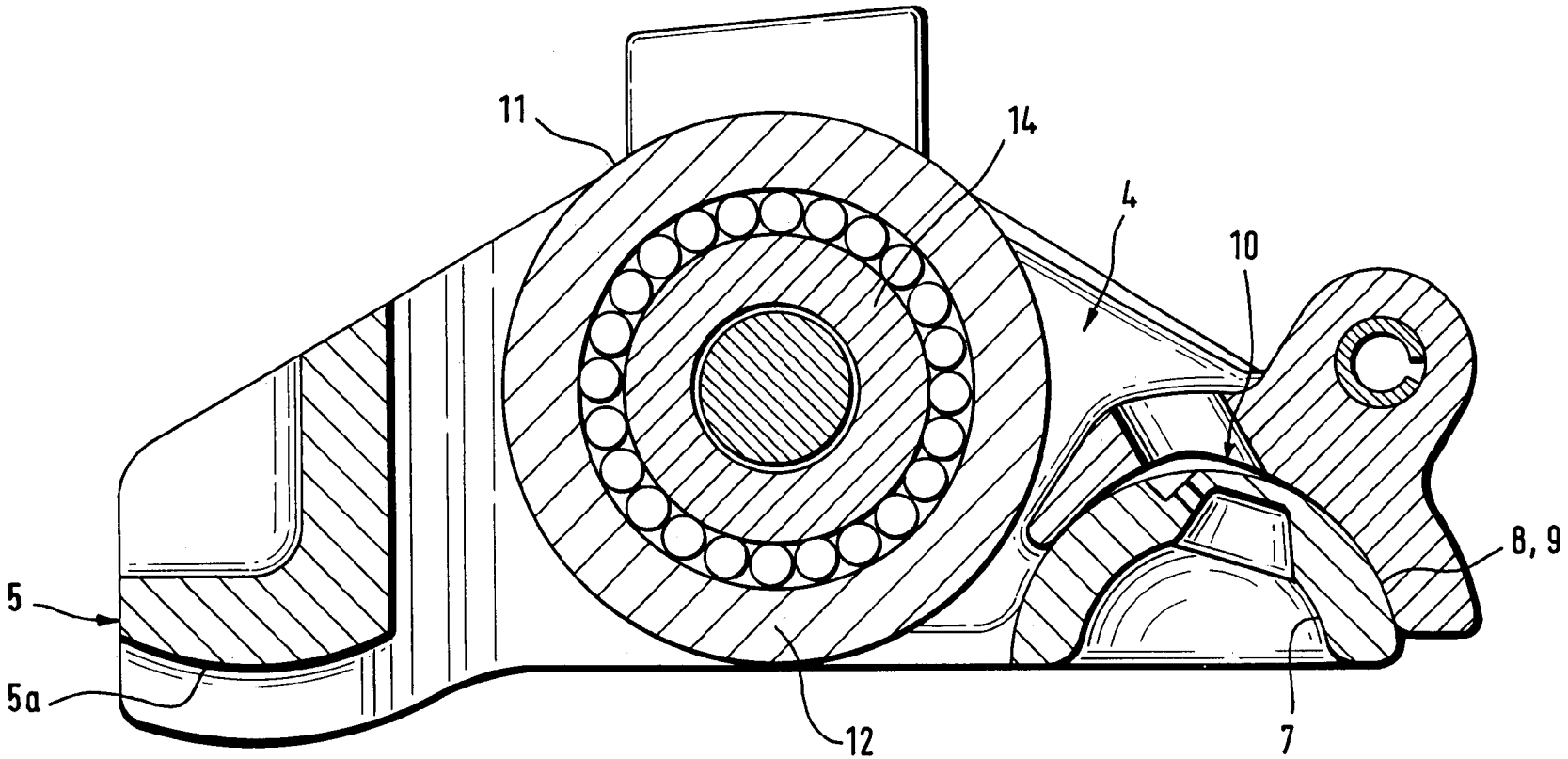
FIG. 3 shows a central longitudinal section through the finger lever of FIG. 1.

FIG. 1 discloses the finger lever 1 of the invention. This finger lever 1 comprises a fork-shaped outer lever 2 having two arms 3*a*,3*b*. An inner lever 4 is received for pivoting between the arms 3*a*, 3*b*. At its closed end 5 (underside), the outer lever 2 acts on an end of a gas exchange valve, not shown. At the opposite end 6, the outer lever comprises a cup-shaped recess that forms a complementary surface 7 (see also FIG. 3). Through this surface 7, the finger lever 1 is supported on a support element, not shown, preferably of a hydraulic type. On the upper side 8 of the cup-shaped recess, a support 9 is formed for the inner lever 4 which is thus pivoted with its fulcrum 10 on the support 9.

Figure 2:
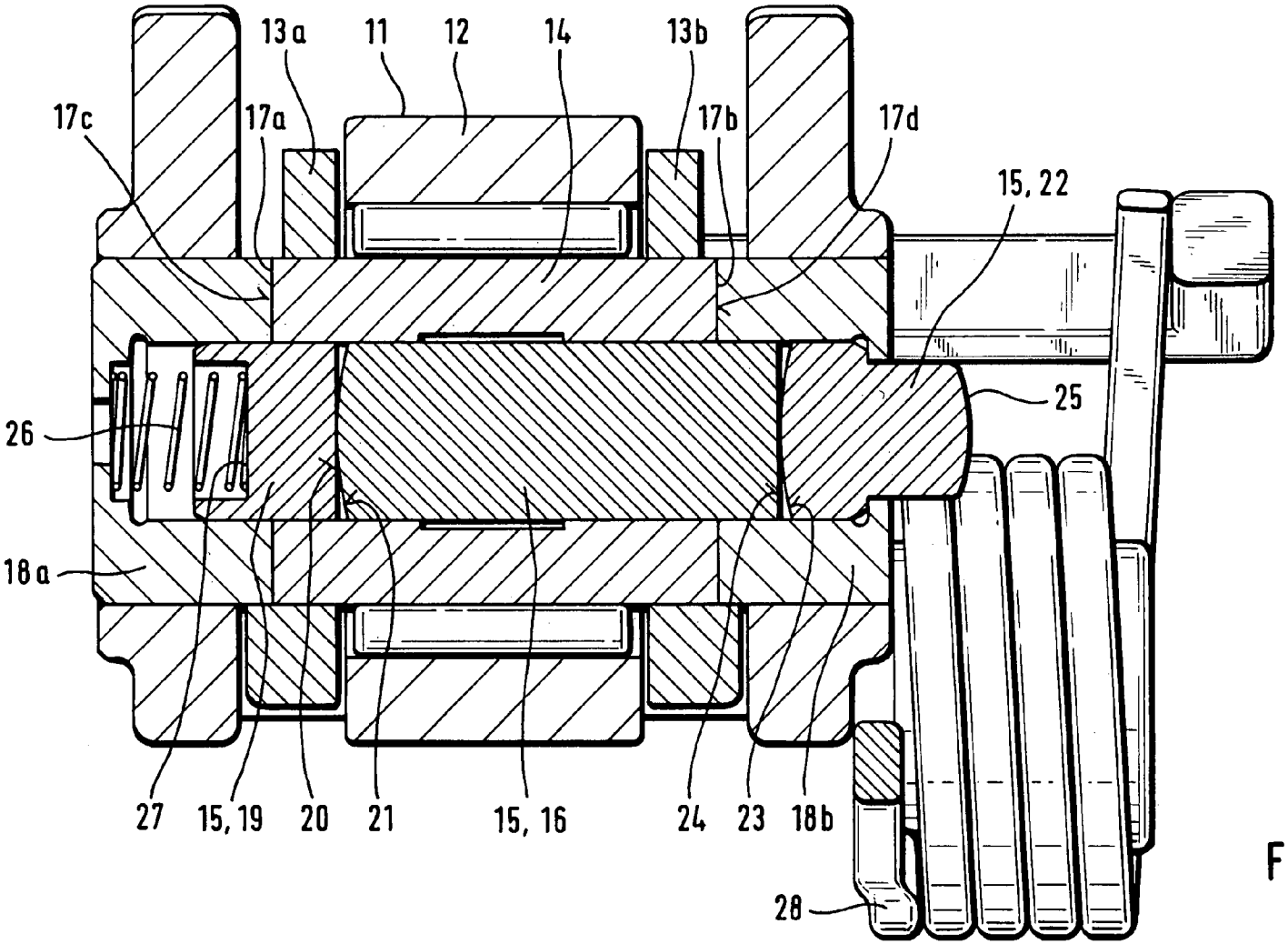
FIG. 2 shows a cross-section through the finger lever of FIG. 1 in the region of the axis of the roller of the finger lever.

Approximately in the region of its central transverse plane, the finger lever 1 comprises a contact surface 11 for a cam (see also FIG. 2). This contact surface 11 is made in the present embodiment as a rolling-bearing mounted roller 12 that is received between arms 13*a*, 13*b* of the inner lever 4 on an end thereof oriented toward the end 5 of the outer lever 2.

The aforesaid roller 12 is arranged on a hollow pin 14 that is float mounted or press fit in the arms 13*a*, 13*b*. At the same time, a first slide 16 forming a part of the coupling means 15 is disposed in the hollow pin 14, which first slide 16 extends in a central position in the hollow pin 14 in the uncoupled state of the finger lever 1. Both end faces 17*a*, 17*b* of the hollow pin 14 are situated in the coupled state or in a cam base circle phase opposite end faces 17*c*, 17*d* of bushing-type receptions 18*a*, 18*b*.

An axially inner end face 20 of a second slide 19 that extends in the reception 18*a* adjoins an outer end face 21 of the first slide 16. In the uncoupled state of the finger lever 1, the end face 17*c* of the second slide 19 is aligned to the end face 17*c* of its reception 18*a*. A third slide 22 is situated diametrically opposite the second slide 19 in the reception 18*b*. In the coupled state, an inner end face 23 of the third slide 22 bears against an outer end face 24 of the first slide 16, while in the uncoupled state, the inner end face 23 is aligned, in its turn, to the end face 17*d* of the corresponding reception 18*b*.

FIG. 2 further shows the third slide 22 displaced axially out of the reception 18*b*. The outer end face 25 of this slide 22 serves in this position as a contact surface for an external loading element like an actuator of an electromagnet or the like.

In the present embodiment, a displacement of the entire pack of slides 19, 16, 22 against the force of the aforesaid actuator is effected by the force of a spring means 26 that loads an axially outer end face 27 of the second slide 19. Thus in the pressure-less state, the entire mechanism is locked.

A lost motion spring 28, that requires no further description here, is mounted on one side of the finger lever between the outer lever 2 and the inner lever 4.

FIG. 1 further discloses that an upper side of the outer lever 2 oriented toward the cam comprises in the region of the arms 3*a*, 3*b* of the upper lever 2, raised counter contact surfaces 29*a*, 29*b*. These cooperate with base circle cams and prevent, as described initially in more detail, a "pumping-up" of the hydraulic support element in the uncoupled state of the finger lever 1. If desired or necessary, these counter contact surfaces 29*a*, 29*b* may also be configured as contact surfaces for low lift cams.

Figure 4:
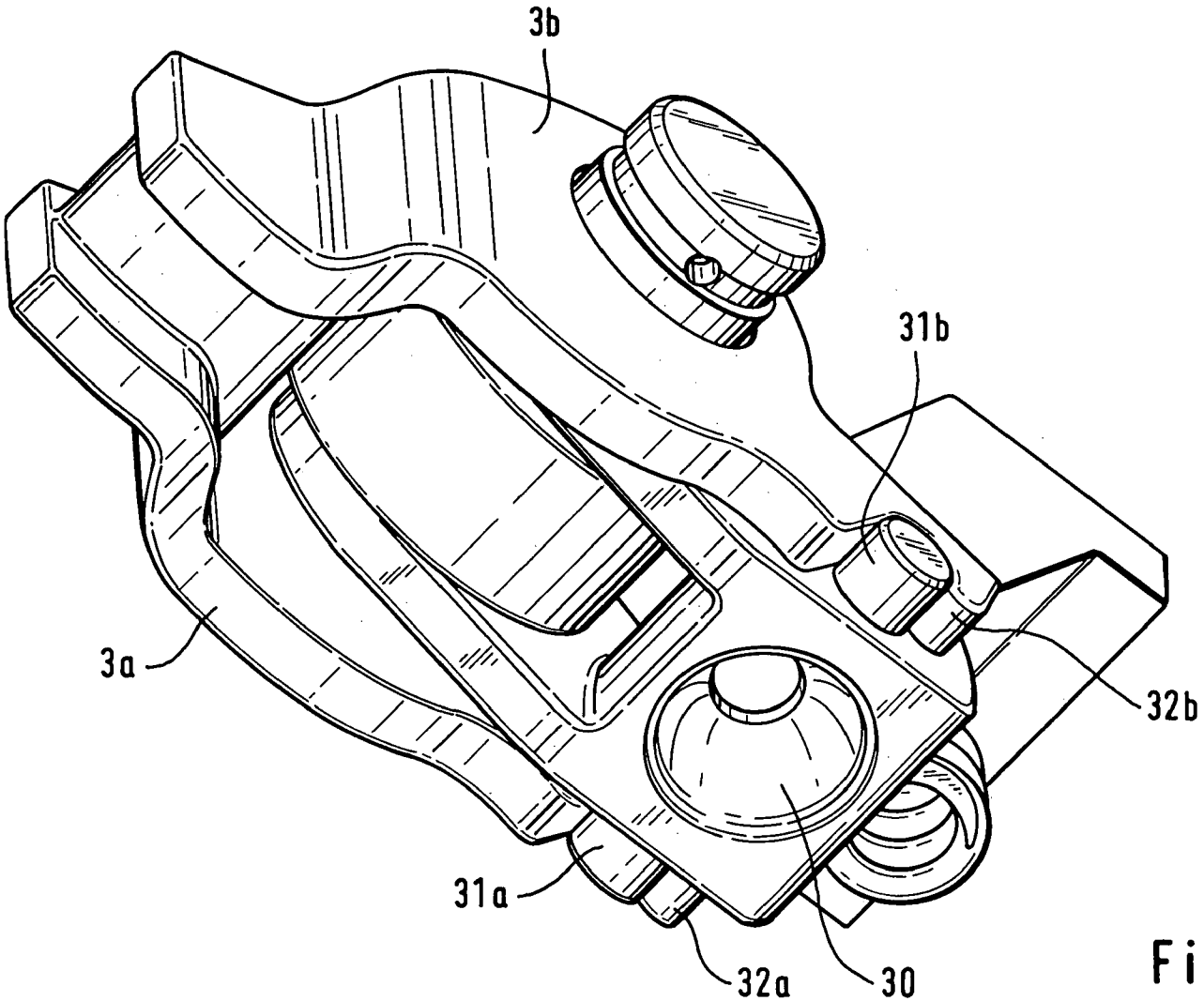
FIG. 4 is a three-dimensional bottom view of the finger lever of the invention.

FIG. 4 discloses an advantageous means of connecting the outer lever 2 to the inner lever 4. The inner lever 4 comprises a complementary surface 30 for mounting on the end of the support element, and it further comprises two laterally projecting axle stubs 31*a*, 31*b* on which the arms 3*a*, 3*b* of the outer lever 2 are supported through respective mounting eyes 32*a* and 32*b*.

Figure 5:
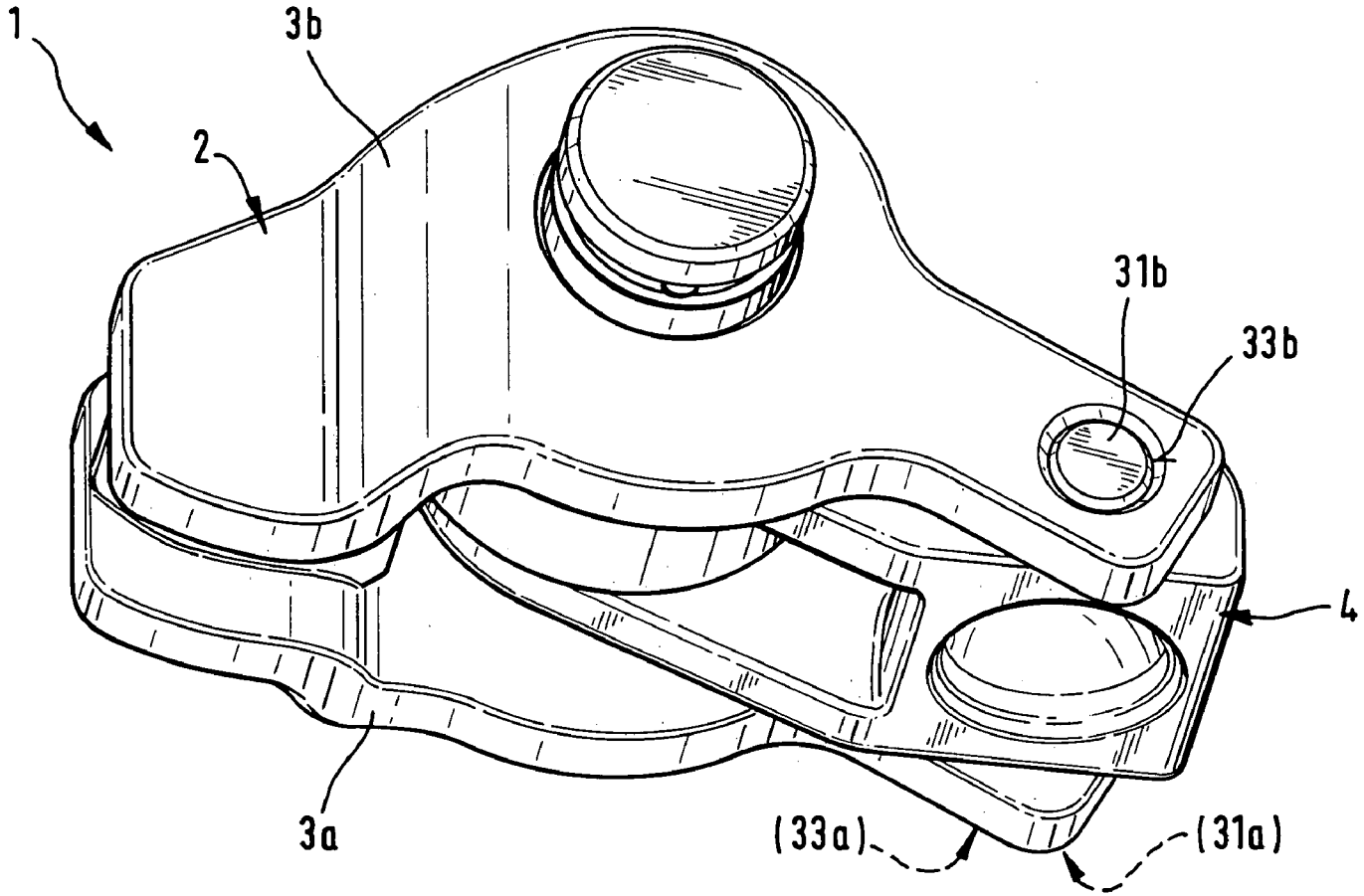
FIG. 5 is a three-dimensional bottom view of another finger lever of the invention.

FIG. 5 shows an embodiment of the finger lever 1 in which the outer lever 2 is not mounted through mounting eyes on the axle stubs 31*a*, 31*b* but through bores 33*a*, 33*b*. If desired or necessary, as described above, a continuous axle may also be used.

What is claimed is:

1. A finger lever of a valve train of an internal combustion engine, said finger lever being switchable to different valve lifts for at least one gas exchange valve and comprising an outer lever having two arms between which an inner lever is arranged for pivoting relative to the outer lever, which outer and inner levers can be coupled to each other by a coupling means, the outer lever comprising on one closed end a support for a gas exchange valve and the finger lever comprising on an opposite end, a complementary surface for a support element, the inner lever having a fulcrum in a region of the opposite end, and at least this inner lever comprising a contact surface for a cam, wherein the outer lever has a substantially open fork-like configuration, the contact surface for the cam on the inner lever is configured as a rotatable roller and the coupling means comprises at least one slide that extends crosswise to a longitudinal direction of the finger lever, an axial line of the at least one slide coincides with an axial line of the roller, and the fulcrum of the inner lever is situated at least approximately at a same point on a length of the finger lever as a fulcrum of the outer lever in a region of the complementary surface of the finger lever, the complementary surface for the support element is arranged on the inner lever and is configured as one of a cup-shaped recess and a cylindrical recess, axle stubs being arranged laterally of said recess on the inner lever, on which axle stubs the arms of the outer lever are mounted through one of the mounting eyes and bores surrounding the axle stubs.

2. A finger lever of claim 1, wherein the roller is mounted in the inner lever on a hollow pin in which a first slide forming a part of the coupling means and having a length equal to a length of the hollow pin extends, end faces of the hollow pin are situated opposite end faces of bushing-type receptions in the arms of the outer lever, in which receptions a second and a third slide are received, and axially inner end faces of said second and third slides are aligned to the end faces of the receptions in an uncoupled state of the finger lever.

3. A finger lever of claim 2, wherein the first, second and third slides are loaded in one axial direction by a force of at least one mechanical spring means that acts at least indirectly on an outer end face of one of the second and third slides.

4. A finger lever of claim 3, wherein the spring means is a coil spring.

5. A finger lever of claim 3, wherein the outer end face of the other of the second and third slides extends axially out of the arm of the outer lever in which said other of the second and third slides is situated, said outer face being configured as a contact surface for an external loading means for the coupling means.

6. A finger lever of claim 2, wherein a fixing of the hollow pin in the inner lever and a fixing of the bushing-type receptions in the outer lever is effected by one of pressing-in, swaging and gluing.

7. A finger lever of claim 1, wherein the inner lever has an open fork-like configuration and comprises arms that are oriented toward the one end of the outer lever, and the roller is received between the arms of the inner lever.

8. A finger lever of claim 1, wherein the outer lever comprises on a side oriented toward the cam, two raised counter contact surfaces for corresponding base circle or low lift cams.

9. A finger lever of claim 1, wherein at least one of the outer lever and the inner lever is made of a light-weight material.

10. A finger lever of claim 9, wherein the light-weight material is a sheet metal.

11. A finger lever of a valve train of an internal combustion engine, said finger lever being switchable to different valve lifts for at least one gas exchange valve and comprising an outer lever having two arms between which an inner lever is arranged for pivoting relative to the outer lever, which outer and inner levers can be coupled to each other by a coupling means, the outer lever comprising on one closed end a support for a gas exchange valve and the finger lever comprising on an opposite end, a complementary surface for a support element, the inner lever having a fulcrum in a region of the opposite end, and at least this inner lever comprising a contact surface for a cam, wherein the outer lever has a substantially open fork-like configuration, the contact surface for the cam on the inner lever is configured as a rotatable roller and the coupling means comprises at least one slide that extends crosswise to a longitudinal direction of the finger lever, an axial line of the at least one slide coincides with an axial line of the roller, and the fulcrum of the inner lever is situated at least approximately at a same point on a length of the finger lever as a fulcrum of the outer lever in a region of the complementary surface of the finger lever, the complementary surface for the support element is arranged on the inner lever and is configured as one of a cup-shaped recess and a cylindrical recess, an axle extends through the inner lever above or at least outside of said recess, and the arms of the outer lever are mounted through one of mounting eyes and bores surrounding ends of the axle that extend laterally out of the inner lever.

* * * * *